US011738239B2

(12) United States Patent
King et al.

(10) Patent No.: US 11,738,239 B2
(45) Date of Patent: Aug. 29, 2023

(54) SYSTEMS AND METHODS FOR DYNAMICALLY LIGHTING A FLUID-RESISTANCE EXERCISE MACHINE

(71) Applicant: WATERROWER INC., Warren, RI (US)

(72) Inventors: Peter King, Warren, RI (US); Chris Footner, Christchurch (GB)

(73) Assignee: Waterrower Inc., Warren, RI (US)

( * ) Notice: Subject to any disclaimer, the term of this patent is extended or adjusted under 35 U.S.C. 154(b) by 153 days.

(21) Appl. No.: 16/744,953

(22) Filed: Jan. 16, 2020

(65) Prior Publication Data

US 2020/0222762 A1 Jul. 16, 2020

Related U.S. Application Data

(60) Provisional application No. 62/793,156, filed on Jan. 16, 2019.

(51) Int. Cl.
*A63B 24/00* (2006.01)
*A63B 21/008* (2006.01)
(Continued)

(52) U.S. Cl.
CPC ..... *A63B 24/0087* (2013.01); *A63B 21/0084* (2013.01); *A63B 22/0076* (2013.01);
(Continued)

(58) Field of Classification Search
CPC ..... A63B 21/0084; A63B 22/0076; A63B 24/0062; A63B 24/0087; A63B 71/0622;
(Continued)

(56) References Cited

U.S. PATENT DOCUMENTS 7,628,739 B2 * 12/2009 Gearon ..... A63B 22/0007 188/290
9,974,995 B2 * 5/2018 Hall ..... A63B 21/4035
(Continued)

OTHER PUBLICATIONS

Screen captures from YouTube video clip entitled "Lighting up a rowing machine (erg) with a 3W RGB LED," uploaded on Feb. 23, 2016, by user "ohmygar42". Retrieved from Internet: <https://www.youtube.com/watch?v=iHAfSbsQnVI>.*
(Continued)

*Primary Examiner* — Megan Anderson
(74) *Attorney, Agent, or Firm* — Nutter McClennen & Fish LLP

(57) ABSTRACT

An illumination device for directing light into a transparent fluid tank of a fluid-resistance exercise machine is disclosed. The device can be coupled with an exterior surface of the tank and includes a light source oriented to project light through a surface and into a region of the fluid tank where the light can be observed by a user of the machine during operation, especially when a rotary device disturbs the fluid to generate the fluid resistance effect. The illumination device can include a control unit having a processor and a communication device, where the communication device receives an exercise-related parameter relayed during operation of the exercise machine. In response the control unit can dynamically adjust a quality of the light as a function of the received parameter, such as heartrate, output, resistance, time, distance, or speed.

19 Claims, 15 Drawing Sheets

(51) Int. Cl.
*A63B 22/00* (2006.01)
*A63B 71/06* (2006.01)

(52) U.S. Cl.
CPC ..... *A63B 24/0062* (2013.01); *A63B 71/0622* (2013.01); *A63B 2022/0079* (2013.01); *A63B 2024/0065* (2013.01); *A63B 2024/0068* (2013.01); *A63B 2220/20* (2013.01); *A63B 2220/30* (2013.01); *A63B 2220/51* (2013.01); *A63B 2220/62* (2013.01); *A63B 2225/50* (2013.01); *A63B 2225/74* (2020.08); *A63B 2230/06* (2013.01); *A63B 2230/062* (2013.01)

(58) Field of Classification Search
CPC .... A63B 2022/0079; A63B 2024/0065; A63B 2024/0068; A63B 2024/0081; A63B 2024/0096; A63B 2071/0675; A63B 2209/10; A63B 2220/20; A63B 2220/30; A63B 2220/51; A63B 2220/62; A63B 2220/80; A63B 2220/836; A63B 2225/50; A63B 2225/74; A63B 2230/06; A63B 2230/062
See application file for complete search history.

(56) References Cited

U.S. PATENT DOCUMENTS

| | | | | |
|---|---|---|---|---|
| 10,493,310 | B2 * | 12/2019 | King | A63B 21/4035 |
| 10,816,177 | B1 * | 10/2020 | Bayerlein | A63B 71/0622 |
| 10,835,781 | B2 * | 11/2020 | Sands | A63B 21/4035 |

OTHER PUBLICATIONS

Rowing Machine with LED Light, https://www.youtube.com/watch?v=0FCq_BB4UVs (Year: 2017).*
Fre-Fitness Equipment custom machine, : https://www.facebook.com/FREallen/ (Year: 2017).*

* cited by examiner

SEAT-SIDE VIEW

CONTAINER-SIDE VIEW

TOP VIEW

SIDE VIEW

SYSTEMS AND METHODS FOR DYNAMICALLY LIGHTING A FLUID-RESISTANCE EXERCISE MACHINE

CROSS REFERENCE TO RELATED APPLICATIONS

The present application claims priority to U.S. Provisional Patent Application Ser. No. 62/793,156, filed Jan. 16, 2019, and entitled "SYSTEMS AND METHODS FOR DYNAMICALLY LIGHTING A FLUID-RESISTANCE EXERCISE MACHINE," the contents of which are incorporated by reference herein in its entirety.

FIELD

The present disclosure relates generally to exercise equipment, and more particularly, to an exercise machine having a fluid container with an illumination device providing dynamic illumination of the fluid container in response to operation of the exercise equipment

BACKGROUND

In recent years, the health and wellness industry has seen a dramatic increase in the popularity of exercise equipment. At the same time, exercise equipment that accurately simulates a given physical activity has grown particularly popular. This way, a user may exercise within the comforts and convenience of a gym, or even in one's own home, while achieving an experience that parallels that of an actual sport and/or activity. To this point, many rowers prefer rowing machines which employ a fluid-based resistance force, as it more closely simulates the action of rowing on actual water. By using fluid, rather than a weight-based resistance, a fluid connection is created between the rower and the fluid, typically via a paddle-like object immersed in the fluid. As a result, contact between the paddle face and the fluid acts to dampen out any mechanical feel.

SUMMARY

Certain aspects of the present disclosure provide for a visible indicator to a user of a fluid-resistance rowing machine and trainers in the studio. The use of a transparent fluid container presents a unique visual aesthetic to the user which can be highlighted using illumination. Additionally, dynamic illumination of the fluid container enables information to be presented to the user in a vivid and easy to observe manner during exercise. For example, a user's heart rate can be presented using different colored illumination of the fluid tank, where a user can quickly observe if their hearth rate is in a desire range based on the color projected into the fluid container, or if they should increase or decrease their exercise output. In some aspects, one or more light sources (e.g., LEDs) indicate heartrate zones that the user is currently rowing at or towards by illuminating a water-tank with one of many different colors that each corresponds to a different heartrate zone. Because fluid-resistance typically involves the movement of a paddle or other fluid-disruption device moving through the fluid in the container, turbulence is generated during operation and this turbulence, when illuminated, increases the scattering and diffusion of the projected light throughout the container, thereby ensuring the light projected into the container can be easily observed by the user or at any vantage point where the container is visible.

In one example, a light housing containing one or more light sources is located centrally underneath and on the outside of a clear (or otherwise at least partially translucent) fluid tank of a water-resistance exercise machine (e.g., a WaterRower, or a fluid-resistance device as described in U.S. application Ser. No. 15/326,941, which is hereby incorporated by reference in its entirety), such that water in the tank acts as a 'diffuser' to spread the light out. In operation, movement of the water in the tank is induced by the user's operation of the exercise machine and illuminating the water both adds to the effect and appealing aesthetics of the machine and provides a highly visible feedback to the user. For example, if the user's heart rate is known (e.g., via contact with sensors on the machine or via communication with an external monitoring device) aspects of the present disclosure enable the fluid tank to be illuminated in different colors depending on the heartrate zone the user is in as they exercise on the machine. In another example, a parameter of the user's operation or the exercise machine can be visually indicated to the user, such as the machine's resistance or speed, or the user's stroke rate, time elapsed, time remaining, distance traveled, distance remaining, or output of the device (e.g., energy input by the user).

Any number of other conditions are able to be presented to the user visually and one skilled in the art would appreciate the scope. As a non-limiting example, the visual indication could provide multiple different indications concurrently. For example, the color of the indication could represent a heartrate zone, and the brightness could indicate an exercise-output metric, such as stroke rate. As another example, the illumination could indicate a user has reached an exercise target by commencing a sequences of pulses. In some instances, the pulses could be changes in brightness, or illumination of different colors. For example, if a user is being provided with a steady orange-illumination of the fluid tank due to their current heartrate and they also fall above or below a current output target a different color light could flash between the steady orange output (or even at the same time), such as red for exceeding an output target or green for falling below and output target.

In yet another example, a user can be alerted to an incoming message or phone call on a phone, computer, or connected home device that is in communication with the illumination device. For example, the illumination system can flash or provide a particular color illumination to alert the user that a doorbell is being rung, or that a particular person is calling their phone. In this manner, a user is able to operate the exercise machine and receive various types of alerts silently.

In still yet another example, multiple exercise machines are in communication with each other or with some centralized processor such that the visual feedback provided to the individual users is adjusted centrally or in response to other users. For example, if multiple users are in a training exercise, and they wish to maintain identical stroke rates, the visual feedback can indicate when a user's output has fallen above or below the average output of the group. In another example, a plurality of users are operating the exercise machines as part of an exercise class, and the instructor can provided target adjustments to the group such that all the machines change their illumination settings together. For example, an instructor could indicate that for 1 minute the target output will increase and ranges for the visual indication of each machines in the class will change together.

In another example, the visual indication can change permanently or temporally upon request of the user. For example, a user operating the machine can adjust the illumination setting by interacting with a control device of the machine to cycle between different illumination modes prior to or during exercise. For example, a use can change from heartrate zones to output to resistance indications. In another example, a program can switch between modes automatically. For example, if a user has chosen an exercise program with a variable difficulty, the illumination device may display their heartrate zone by default, but also indicate to a user each time the difficulty changes.

Certain aspects of the present disclosure include an illumination device that attaches to the outside of a fluid tank to provide illumination into the fluid tank. In other instances, the illumination device is attached to the exercise machine and projects light into the fluid tank. In some instances, one or more separate illumination devices are integrated into the exercise machine, for example, at locations where the fluid tank is coupled to the exercise machine.

In some instances, the illumination device includes an internal power source and an internal control unit. In other instances, the illumination device includes an external power unit and/or an external control unit. In some instances, the illumination device is controlled by a control unit of the exercise machine. In some instances, the illumination device is powered by a same power source of the exercise machine or of a control unit of the exercise machine. In some instances, the illumination device includes a power switch. In some instances, the illumination device includes one or more mode switches to, for example, enable a user to change the brightness or color of one or more light sources of the illumination device.

In some instances, the illumination device includes a single light source. In some instances, the illumination device includes a plurality of light sources. In some instances, the illumination device includes one or more light sources for each primary color. In some instances, the illumination device includes one or more light sources for specific colors, such as orange. In some instances, the illumination device includes a diffuser positioned between the light sources and the fluid tank. In some instances, the illumination device includes light guides to direct the light into the fluid tank at different location or different angles. In some instances, the illumination device includes manual or automatic articulation of the light sources, light guides, or lenses, in other to change the projection of light into the fluid tank. In some instances, the illumination device includes one or more lenses or lens elements.

In some instances, the illumination device includes one or more rings of light sources that are each individually controlled. In some instances, the fluid tank includes a rotary resistance-paddle device and the illumination device is configured to position the rings of light sources concentrically with an axis of the rotary device of the fluid tank.

In some instances, the illumination device or a control unit of the illumination device includes a communication module configured to communicate directly or wirelessly with an external device, such as a control unit of the exercise machine, and user's phone or computer, a network of other exercise machine, a heartrate monitor, a controller of multiple exercise machines, or the internet.

In some instances, the illumination device or a control unit of the illumination device includes a processor in communication with a light source and a non-transitive computer-readable storage medium in communication with the processor and storing instructions to cause the processor to operate the light sources in any of the ways described herein.

In some instances, the illumination device includes an attachment element for securing the illumination device to the fluid tank or to the exercise machine, for example, a surface for an adhesive or hook and loop material, a hole for a fastener, a clip, or other attachment means known to one skilled in the art. In some instances, the fluid tank or the exercise machine has a corresponding attachment element.

In some instances, the illumination device is positioned around a periphery of the fluid tank. In some instances, one illumination device is positioned above the fluid tank and another illumination device is positioned below the fluid tank. One skilled in the art will appreciate that a number of different locations on the fluid tank are suitable for projecting light into the fluid tank and that the location of the illumination device may be a function of providing ideal illumination to the water (e.g., evenly projecting throughout the tank, or reducing scattering outside of the tank) and/or a function of where a frame of the exercise device permits illumination.

In some instances, the fluid tank includes a diffuser section where the illumination device projects the light into the fluid tank though the diffuser section in order to improve the even coverage of the light across the fluid tank. In other instances, the fluid tank includes illumination features on the insides and/or the outside surface of the fluid tank for directing the light from the illumination device into the fluid tank.

In some instances, the illumination device is incorporated into the resistance element inside the fluid tank (e.g., a paddle, the arms connecting the paddle to a central hub, or the central hub itself). In some instances, the illumination device is a separate structure disposed in the fluid tank that can be connected to the resistance element such that the illumination device spins with the resistance element.

In some instances, the illumination device includes UV light sources that are able to fluoresce a fluid or fluid additive that is used in the fluid tank. In some instances, the fluid in the tank is cloudy or contains an additive to decrease the transparency of the fluid by increasing the turbidity and thereby more evenly scatter the light from the light source or scatter a high percentage of the light from the light source.

In some instances, the light source of the illumination device is one or more light emitting diodes (LEDs).

BRIEF DESCRIPTION OF DRAWINGS

This disclosure will be more fully understood from the following detailed description taken in conjunction with the accompanying drawings, in which.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present disclosure is defined solely by the claims. The features illustrated or described in connection with one exemplary embodiment may be combined with the features of other embodiments. Such modifications and variations are intended to be included within the scope of the present disclosure.

Example 1

Figure 1:
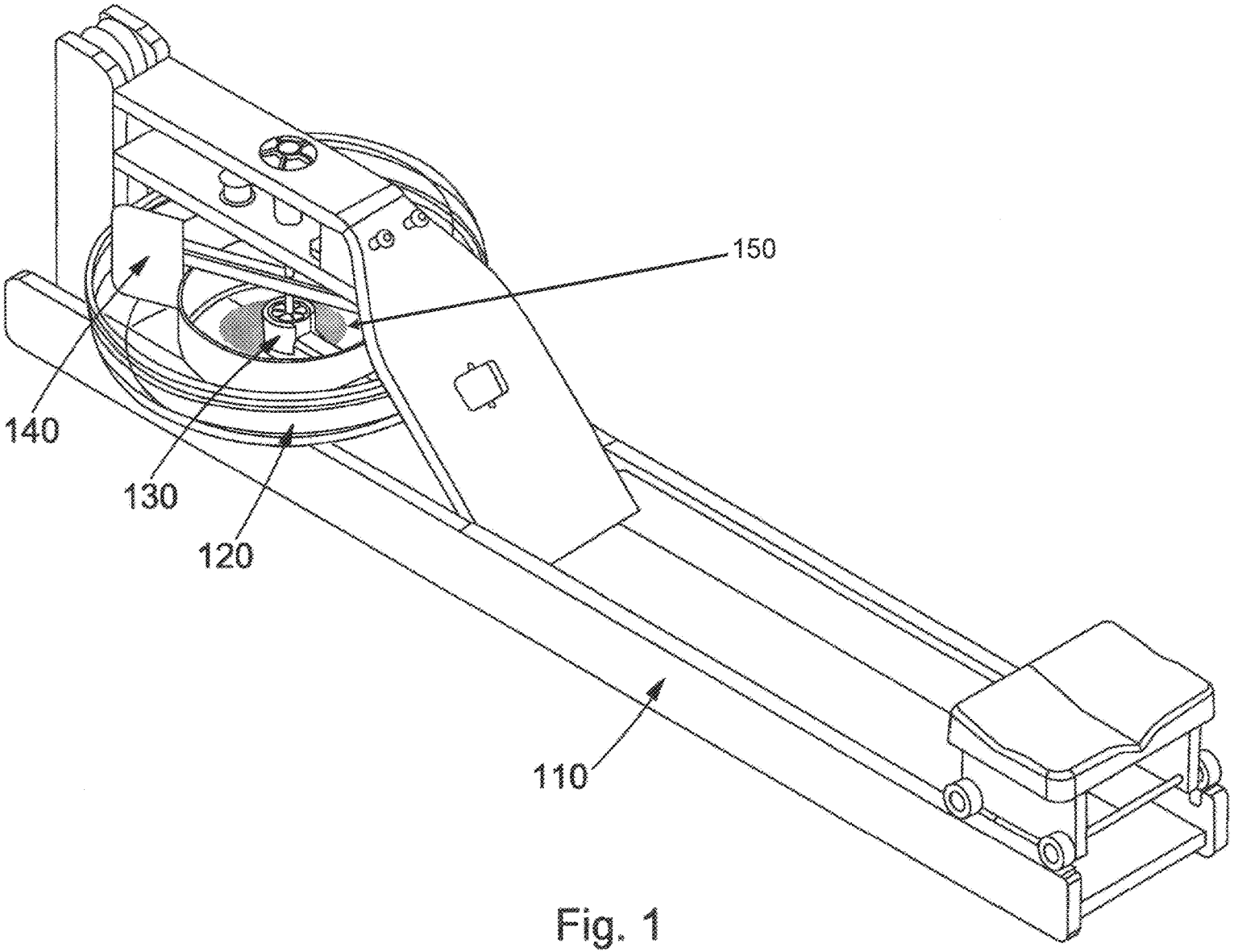
FIG. 1 is an illustration of an exemplary exercise machine assembly according to an embodiment of the present disclosure.

FIG. 1 illustrates an exemplary exercise machine assembly according to an embodiment of the present disclosure. As shown in FIG. 1, the exercise machine assembly 100 includes a frame 110, a hollow fluid container 120, adjustment assembly 130, and fluid displacement device 140. Illustratively, the exercise machine assembly 100 includes a typical rowing machine. Notably however, the applicability of the system and techniques disclosed herein is not limited to rowing machines, as the disclosed embodiments may be applied to any fluid resistance-based exercise machine, particularly those which provide resistance via a supply of fluid in a transparent tank. Therefore, the exercise machine assembly 100 is not necessarily limited to a rowing machine, but may incorporate other types of exercise machines where fluid-based resistance is provided and a user is allowed to exert a force against the resistance force, thereby achieving a workout and able to receive a visual feedback from light scattered from the fluid in the transparent tank.

In the exercise machine assembly 100 depicted in FIG. 1, a rowing machine can be organized about a frame 110 that mounts a hollow fluid container 120 holding a supply of fluid, e.g., water or the like. A fluid displacement device 140, e.g., a paddle or the like, may be rotatably mounted in the fluid container 120 and coupled, e.g., through a double spool and a clutch, to a drive cord and a recoil mechanism of the exercise machine assembly 100 (not shown). The fluid displacement device 140 may be oriented to displace the fluid in the fluid container 120 by rotating the fluid about the major axis of the fluid container 120 in response to a force exerted by the user (e.g., a pulling movement on the drive cord). As a result, the mass of the spinning fluid can produce a momentum effect, and turbulence generated in the fluid can provide the desired resistance. Resistance is also generated by drag resulting from the fluid moving along the interior surface of the fluid container 120. Thus, by increasing the speed of the fluid displacement device 140, thereby increasing the speed of the fluid being displaced, the drag and resulting resistance is also increased.

The fluid container 120 may include a hollow body enclosing the fluid displacement device 140, allowing the fluid displacement device 140 to rotate therein. The fluid container 120 may have a generally cylindrical construction, allowing for fluid to be displaced by the fluid displacement device 140 in a consistent and continuous manner. The fluid container 120 may be designed to contain any amount of fluid depending on the design of the exercise machine assembly 100 (roughly 20 liters is a standard fluid container volume for rowing machines).

Further, the fluid container 120 may include an inner reservoir and an outer reservoir that cause the fluid-based resistance force provided by the exercise machine assembly 100 to vary based on an amount of fluid in the inner reservoir and an amount of fluid in the outer reservoir, as described further below. Notably, by adjusting the volume of fluid in the fluid container 120, and particularly the inner and outer reservoirs, additional simulated effects can be achieved, such as being in a lighter or heavier boat, or changing the gearing of the boat (e.g., the pivot point or mechanical advantage provided by the oar).

The exercise machine assembly 100 may additionally include an adjustment assembly 130. The adjustment assembly 130 may regulate fluid flow from either of the inner reservoir or the outer reservoir to the other. More specifically, the adjustment assembly 130 may establish a plurality of resistance levels by causing predefined amounts of fluid to flow from either of the inner reservoir or the outer reservoir to the other.

The exercise machine assembly 100 includes an illumination device 150 attached to the bottom of the fluid container 120. The illumination device includes a light source that can be arranged to project light up into the fluid into the fluid container 120, where the light is to be scattered by at least one of the fluids in the fluid container 120, the displacement device 140, and the fluid container 120 itself. In some instances, the illumination device 150 includes an internal control unit having a processor, memory, and communication module, where the communication module can be a wired or wireless module configured to receive an input parameter regarding the operation of the exercise machine (e.g., resistance, speed, duration, stroke rate) or the status of the user (e.g., heartrate) to be converted into a visual input conveyed to the user via the light from the light source projected into the fluid container 120.

Figure 2B:
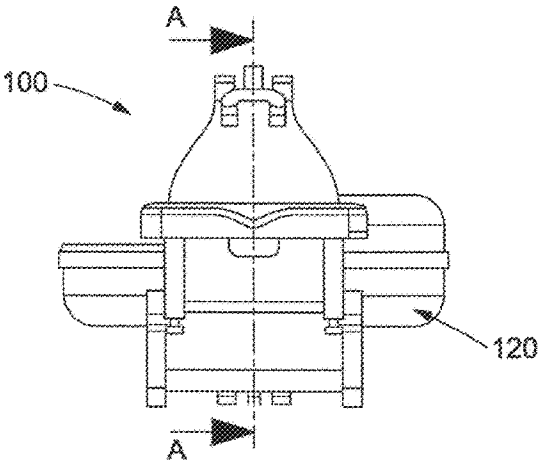
FIGS. 2A-2C illustrate perspective views of the exemplary exercise machine assembly according to an embodiment of the present disclosure.
Figure 2A:
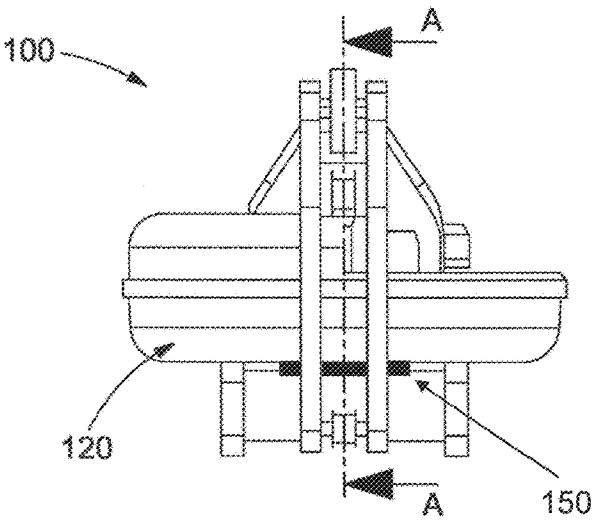
Figure 2C:
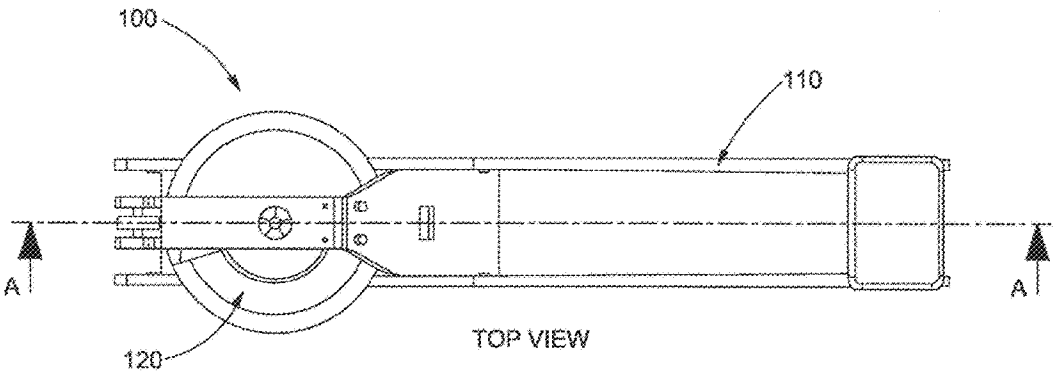

FIGS. 2A-2C illustrate perspective views of the exemplary exercise machine assembly according to an embodiment of the present disclosure. In particular, FIGS. 2A, 2B, and 2C illustrate a fluid container-side view, seat-side view, and top view, respectively, of the exercise machine assembly 100. As shown in FIGS. 2A-2C, a cross-sectional view line A is depicted as bisecting the exercise machine assembly 100 in a longitudinal direction. FIG. 2A shows the illumination device 150 mounted to the bottom of the fluid container 120.

Figure 3:
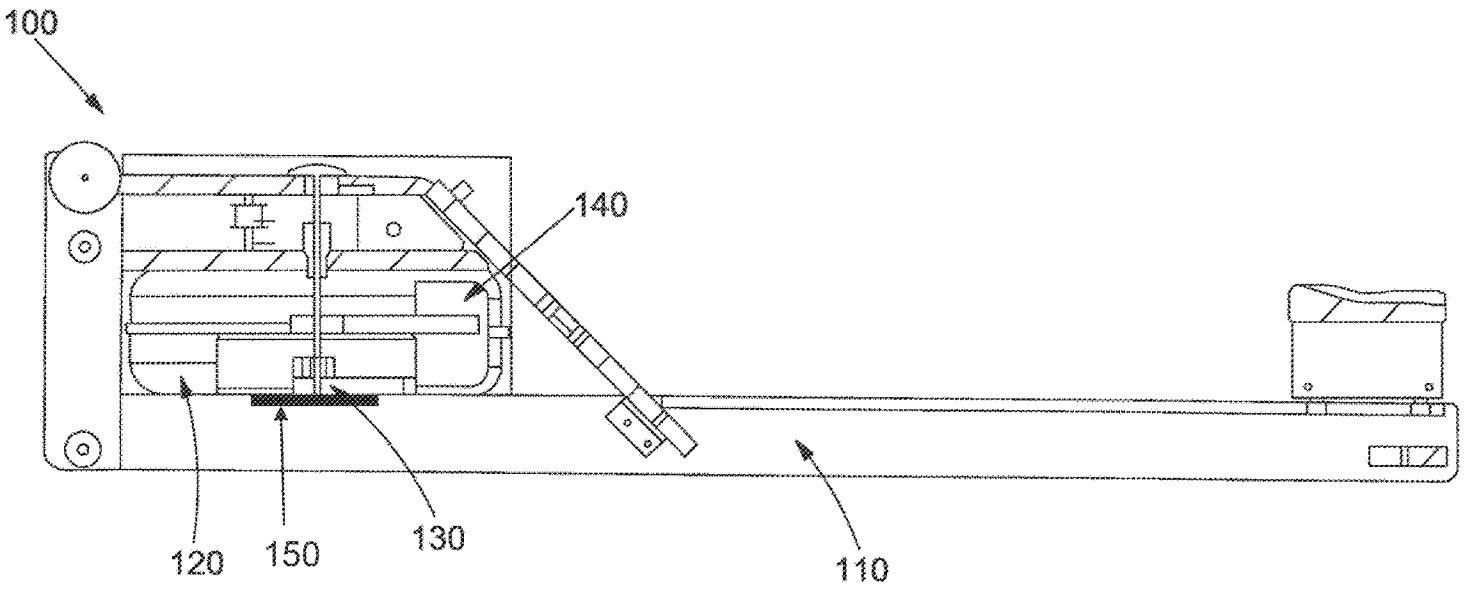
FIG. 3 illustrates a cross-sectional side view of the exemplary exercise machine assembly according to an embodiment of the present disclosure.

FIG. 3 illustrates a cross-sectional side view of the exemplary exercise machine assembly according to an embodiment of the present disclosure. The exercise machine assembly 100, as depicted in FIG. 3, is shown from the perspective of cross-sectional view line A. As explained above, the exercise machine assembly 100 may include a frame 110, a hollow fluid container 120 mounted to the frame 110, and a fluid displacement device 140 coupled to the exercise machine assembly 100 and enclosed within the fluid container 120. The exercise machine assembly 100 includes the illumination device 150 shown centrally located with respect to the axis of the fluid displacement device 140. Illustratively, the fluid container 120 and fluid displacement device 140 may be oriented horizontally with respect to the exercise machine assembly 100. However, the disclosed embodiments are also applicable to fluid containers and fluid displacement devices that are oriented vertically or otherwise with respect to the exercise machine assembly.

Example 2

Certain aspects of the present disclosure provide an exercise machine with an illumination device to create a visible indicator to the user of the rowing machine and trainers in the studio via illumination of a fluid container. In one particular instance, the light emitted by the illumination device into the fluid container indicates heartrate zones that the user is currently rowing at or towards.

Figure 4A:
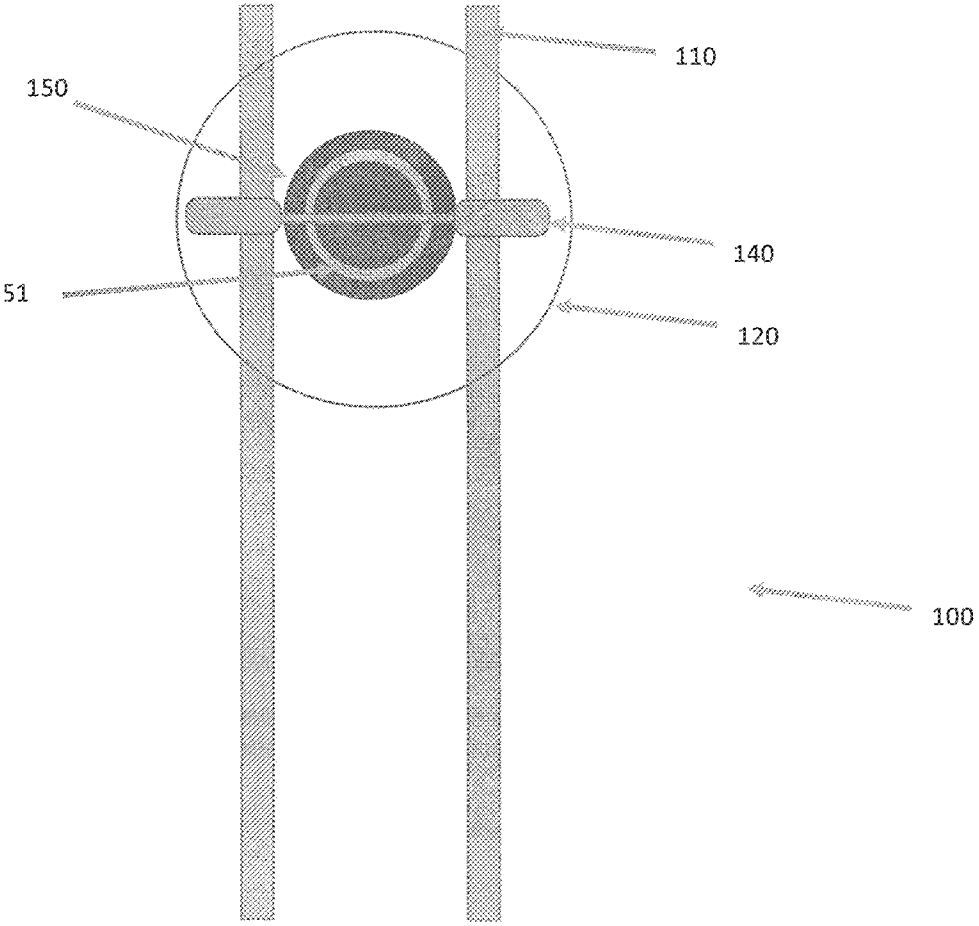
FIGS. 4A and 4B are illustrations of an exercise device including a fluid tank and an illumination device.
Figure 4B:
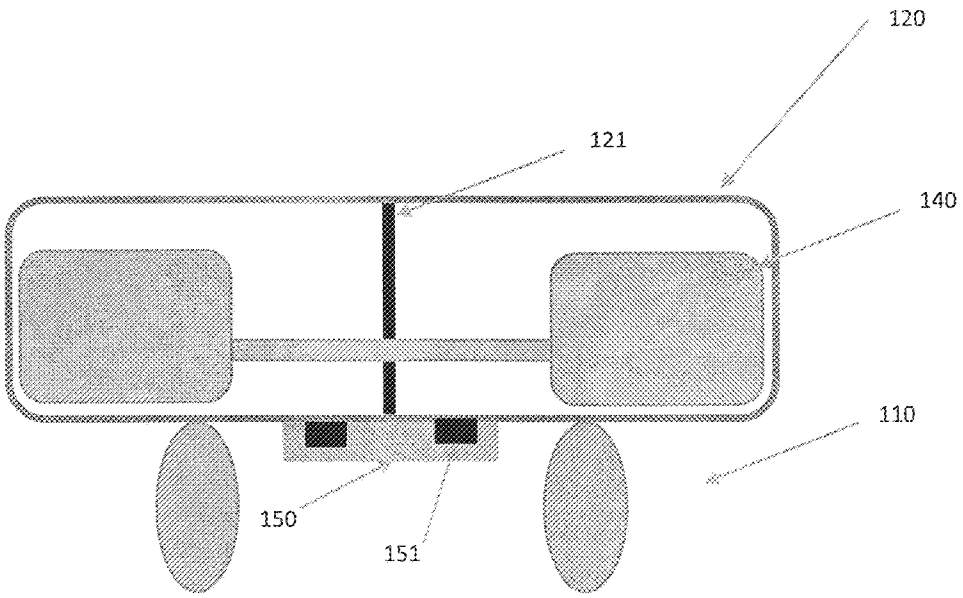

FIGS. 4A and 4B are illustrations of an exercise device 100 including a fluid tank 120 (e.g., a water tank) and an illumination device 150. FIG. 4A is a top-down view of the exercise machine 100 showing the frame 110 and transparent fluid tank 120, with an illumination device 150 (e.g., an LED housing) attached to a bottom side of the fluid tank 120. A light source or light illumination region 151 (e.g., a diffuser position above a light source) of the illumination device 150 is visible through the transparent fluid tank 120. The illumination region 151 can be arranged to project light into the fluid tank 120 in order to, for example, be scattered or diffused by a fluid in the fluid tank 120 during operation of the exercise device 100. For example, when a rotary device 140 spins in the water 120 to generate a resistance force, the water or fluid in the tank 120 is disturbed, turbulence is generated, which increases the dispersion or scattering of light incident on the fluid from the illumination region 151.

FIG. 4B shows a cross-section view of the fluid container 120 and the illumination device 150. The location of illumination device 150 can situated centrally underneath, on the outside of the clear (or at least partially transparent) fluid container 120 of the exercise machine 100. In operation, the fluid (e.g., water) in the fluid container 120 acts as a 'diffuser' to spread the light out. The movement of the fluid induced by the paddles 140 of the rotary device during operation (i.e., spinning of the paddles 140 through the fluid to generate a fluid-based resistance exercise) adds to the effect and appealing aesthetics of the machine 100 and results in the user of the machine observing an increase in light output from the fluid container 120 during operation.

FIG. 4B shows the illumination region 151 of the illumination device 150 being positioned concentrically about an axel 121 of the rotary device in the fluid container 120. The illumination region 151 can form a ring or other symmetric shape about the axel 121 in order to evenly or symmetrically illuminate the fluid container 120. Other arrangements are considered, for example, to illuminate a region of the fluid container 120 visible to the user. In some instances, the illumination region 151 can form a pattern of illumination base on either the shape or pattern of the illumination region 151, or the control of a plurality of light sources in the illumination region 151. For example, the illumination region 151 may form a ring diffuser above a number of light sources positioned around the ring and a pattern of light can be created depending on which light sources are triggered and in what order in the illumination region 151.

In a particular example, the illumination device 150 is configured to indicate the current heartrate zone of the user and receives an input from, for example, a heart rate sensor positioned to measure the heartrate of the user operating the exercise machine. The illumination device 150 can project light of different colors into the fluid container 120 depending on the current heart rate of the user, for example, a "Zone 1" being a light glow, a "Zone 2" will be a bright blue, a "Zone 3" will be a green, a "Zone 4" being orange and a "Zone 5" will be a strong red. Where Zone 1 is, for example, a low or resting heartrate below 60% of a maximum for the user, Zone 2 is a 'warm up' zone representing 61-70% of the maximum, Zone 3 is a 'challenging' zone representing 71-83% of the maximum, Zone 4 is an 'uncomfortable' zone representing 84-91% of the maximum, and Zone 5 is an 'all-out effort' zone representing 92-100% of the maximum.

Figure 4C:
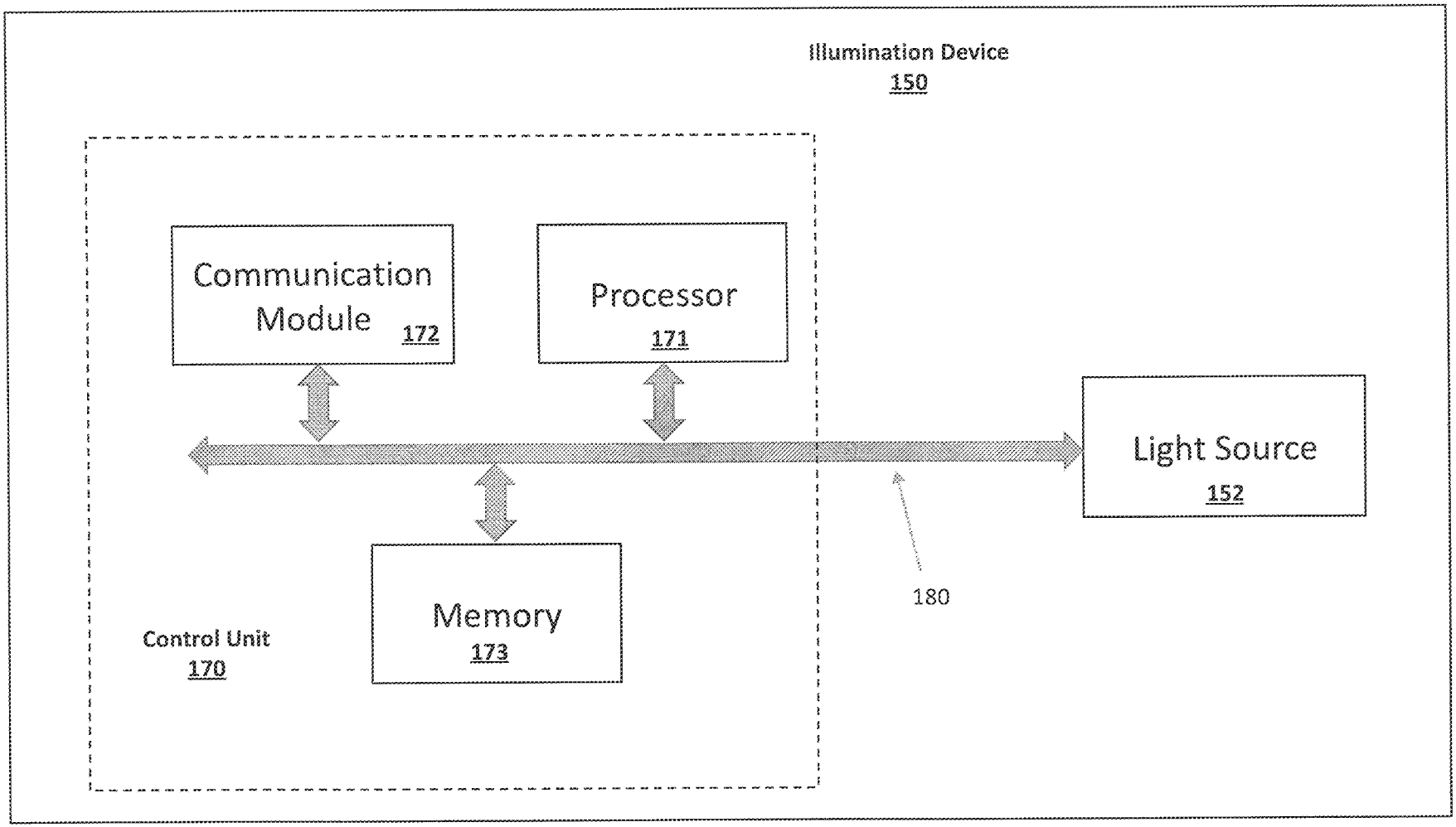
FIG. 4C is a schematic illustration of the components of an illumination device.

The light source of the illumination device can be controlled in different ways. FIG. 4C is a schematic of one embodiment of an illumination device 150 having a control unit 170 connected to a light source 152, where the light source 152 is, for example, an LED or other light emitting module arranged to form the light emitting region 151. The control unit 170 can include a processor 171, a communication module 172, and memory 172. The control unit 170 can be configured to provide a control signal to the light source 152 via a cable 180 or wireless means. In some examples, the control unit 170 is configured to directly power the light source 152. In other instances, the illumination device has an internal source of power, such as a battery, which provides power to one or both of the control unit 170 and light source 152. The illumination device 150 can also be externally powered. In some examples, the illumination device is hardwired or tethered via a serial line to a control unit of the exercise machine 100. In some examples, the control unit 170 is integrated with the exercise machine 100, and in other examples both the exercise machine 100 and the illumination device 150 have separate control units. In some examples, the illumination device 150 is configured to operate independently of the exercise machine, for example, being able to directly receive an exercise parameter from an external device or sensor, such as a heart rate monitor worn by the users or a central control system in an exercise classroom environment, or any other electronic communication means.

In another example, the communication module 172 of the illumination device 150 includes a wireless communication module, such as a standard BLE (Bluetooth) module. In another example, the illumination device 150 receives a direct sensor input (e.g., a heart rate sensor). In yet another example, the illumination device 150 receives a sensor input from a sensor of the exercise machine 100 (e.g., a heartrate sensor, a speed sensor, or a resistance sensor). In some instances, the illumination device 150 includes a controller having a push button for manual change of the LEDs color or sequences or other operative functions of the illumination device 150.

In some instances, the illumination device 150 has multiple groups of different illumination devices 150. In some instances, the illumination device 150 contains a memory unit 173 storing different operative illumination or parameter modes. In some instances, the illumination device can be programmed to have different light sequences or patterns, for example, to indicate a timer countdown or visual heartrate pulses. In some instances, the illumination device 150 can indicate that the exercise machine 100 is available for use, for example, with a new color that pulses when the machine 100 is free to be used by a new user.

In some instances, the illumination device 150 is powered by rechargeable batteries in the unit, an external power pack, or a hardline.

In some instances, the illumination device 150 includes a wireless communication module configured to interface with an application (e.g., a computer program or mobile phone application) such that the application can have full or partial control over the lights color and/or the light sequence.

In some instances, the light source 152 includes a plurality a LEDs and each LED is controllable independent of the others. In some instances, the LED colors available is any combination of Red, Green and Blue. In some instances, brightness of the light source 152 can be adjusted or dynamically control in response to a received parameter, such as hearth rate, speed, exercise output, etc.

Example 3

Figure 5A:
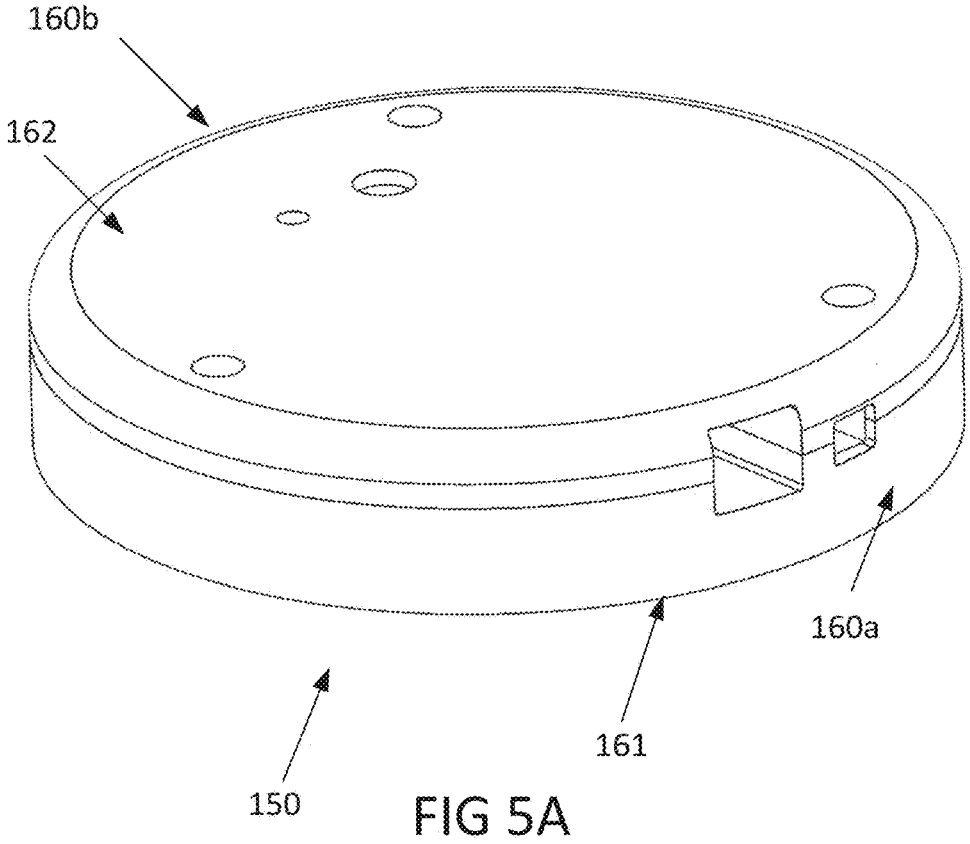
FIGS. 5A and 5B are illustrations of a housing of an illumination device.
Figure 5B:
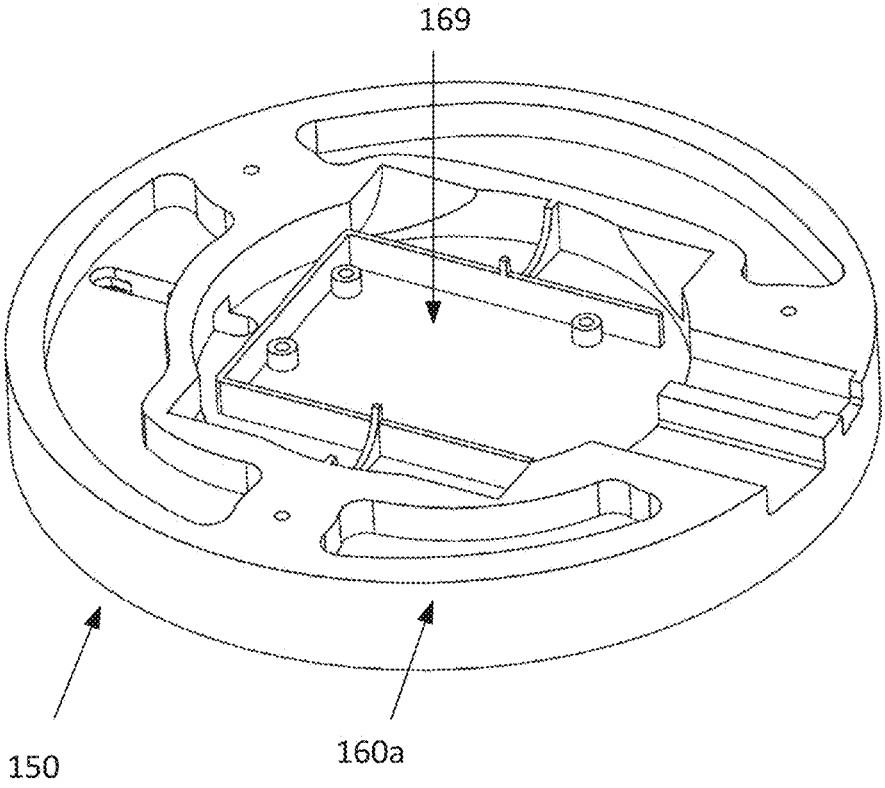

FIGS. 5A and 5B are illustrations an illumination device 150 having a top housing 160*a* and a bottom housing 160*b*, with the top housing 160*a* having a top face 161 with the illumination region 151 (not visible in FIG. 5A) and configured to be positioned against the exterior of the fluid tank 120. The bottom housing 160*b* includes a bottom face 162 which can include buttons or switches accessible by a user. In FIGS. 5A and 5B, the illumination device 150 has an 'all-in-one' design, where all the housings 160*a,b* of the illumination device 150 are sized and shaped to contain a control unit 170 (e.g., electronics) and light source 152 (e.g., LEDs) in one or more internal enclosures 169 of a single unit that can be fitted to the underside of a fluid tank 120. In some instances, the illumination device 150 includes a 3D printed enclosure. In some instances, the illumination device 150 includes a button on the bottom face 162 and a switch for power to the LEDs, as shown in FIG. 6A.

Example 4

Figure 6A:
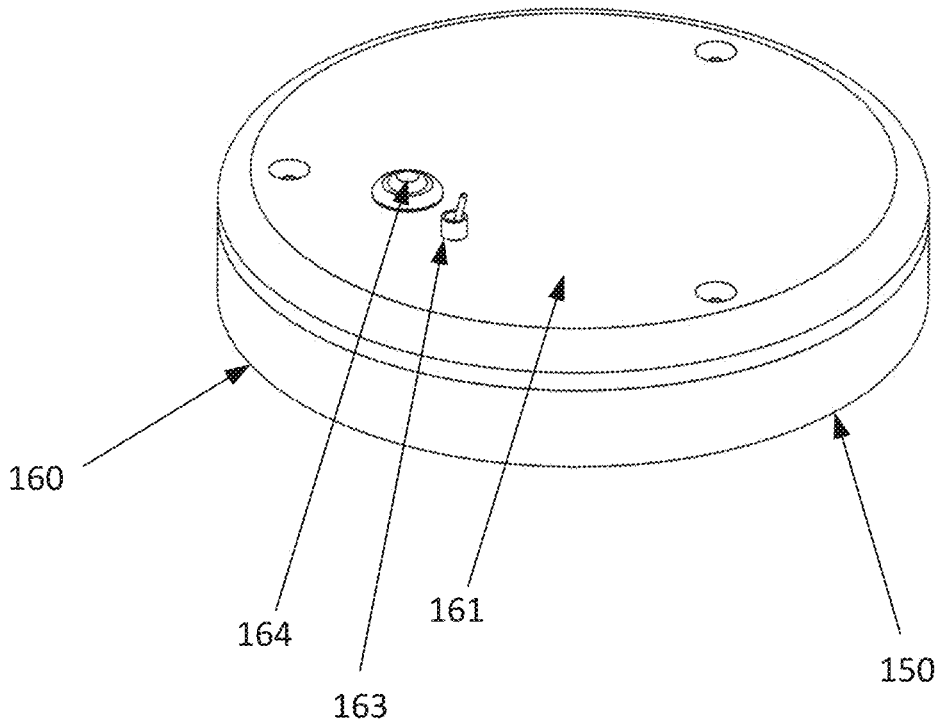
FIGS. 6A-6C are photos of a functioning illumination device.
Figure 6B:
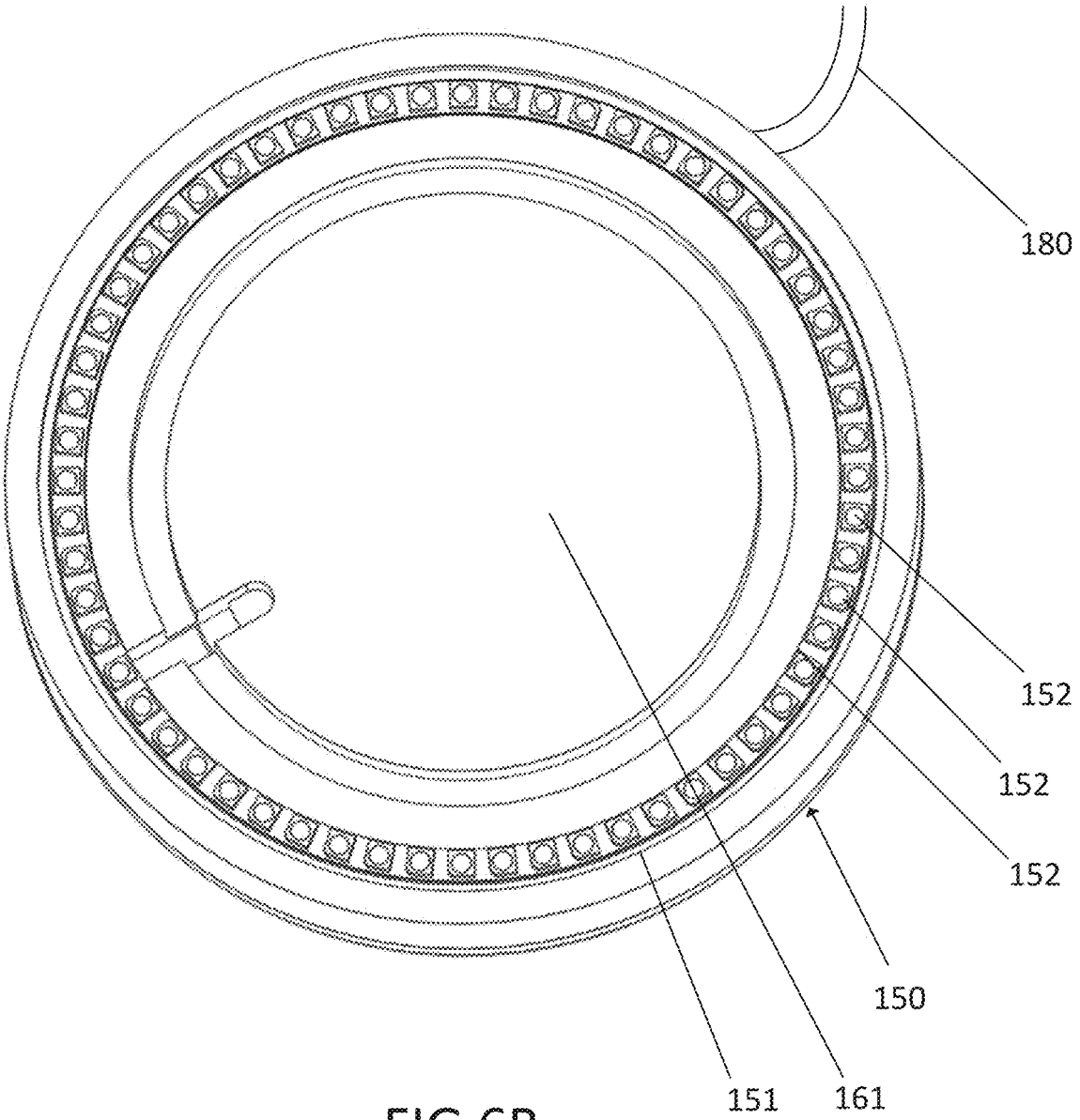
Figure 6C:
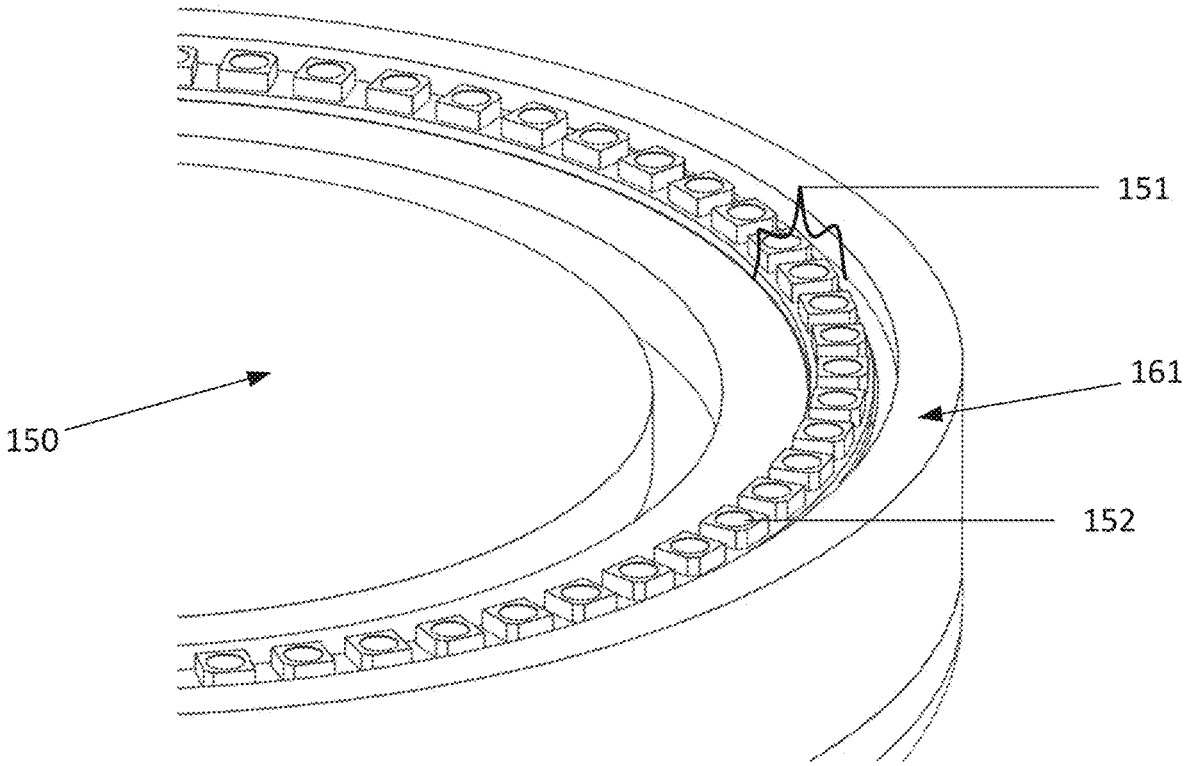

FIGS. 6A-6C are photos of an operational illumination device 150. In some instances, the illumination 150 device houses a plurality of light sources 152 to form an illumination region 151 with a separate electronics assembly. FIG. 6A shows an illumination device having a housing 160 with a bottom face 161 including a mode button 162 and a power switch 163. The power switch 163 can be used to turn the illumination device on and off, and the mode switch 164 can be used to change how the illumination device 150 dynamically responds to a received parameters or which parameter or parameters the illumination device 150 responds to. In some instances, and as shown in FIGS. 7A and 7B, an electronics assembly can be contained in an external control unit 170, which can be carried elsewhere on the exercise machine 100 and connected to the illumination device 150 housing 160 having the light sources 152 via a cable 180.

Example 5

Figures 7A, 7B:
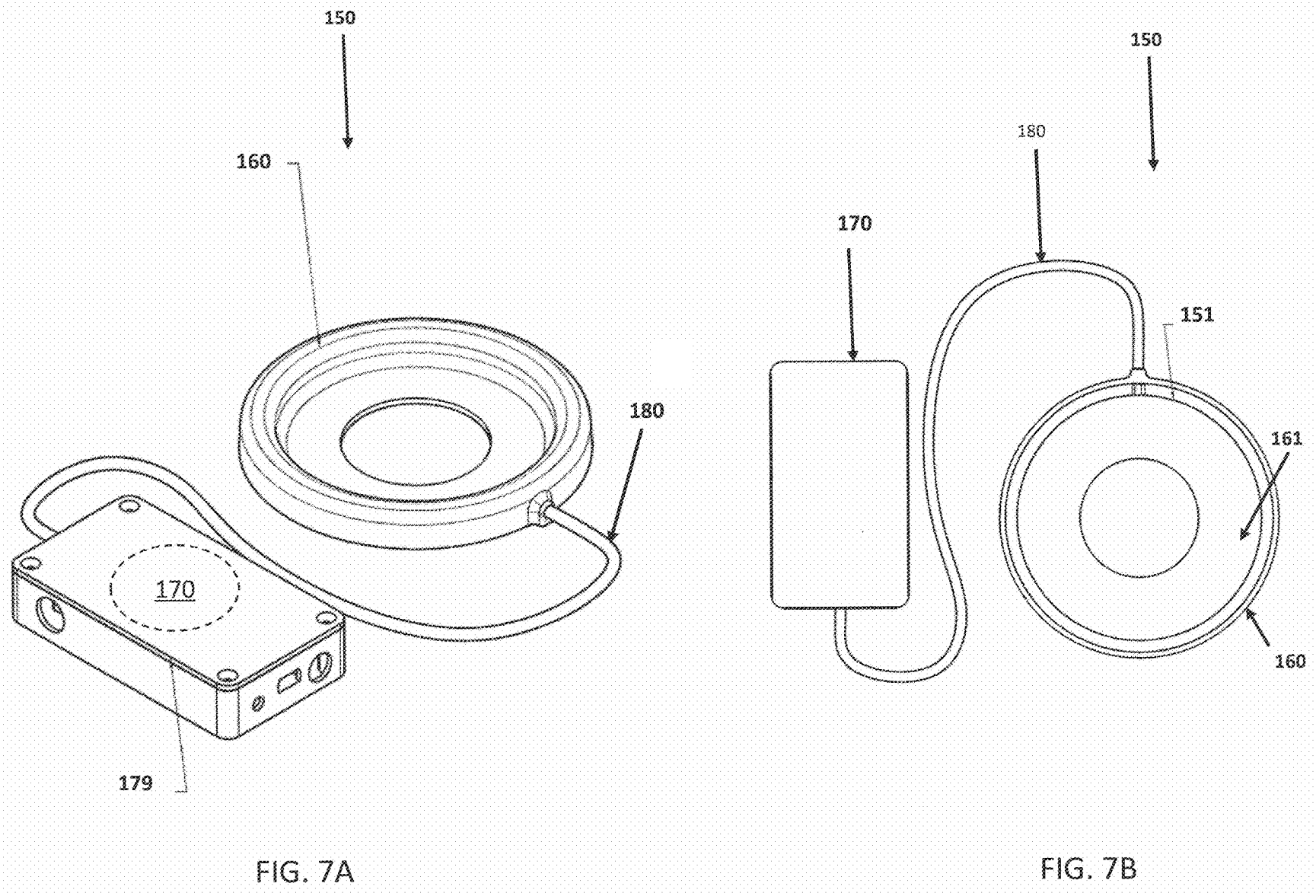
FIGS. 7A and 7B are illustrations of an alternate design of an illumination device having an external control unit.

FIGS. 7A and 7B are illustrations of an alternate design of an illumination device 150 having an external control unit 170 and FIGS. 8A-8D are photos of a fluid tank 120 of an exercise machine 110 with an illumination device 150 coupled thereto.

FIGS. 7A and 7B show an illumination device 150 that includes an illumination housing 160 and an electronics housing 179 having a control unit 170 disposed therein and coupled together via a cable 180. The illumination housing 160 provides a top face 161 with recess having a plurality of light sources (not illustrated in FIG. 7A, but shown as LED light sources 152 in FIG. 6C) disposed therein forming an illumination region 151. The top face 161 of the illumination housing 160 is configured to be attached to the fluid tank 120. The electronic housing 179 provides power to the LEDs and controls their operation.

Figure 8A:
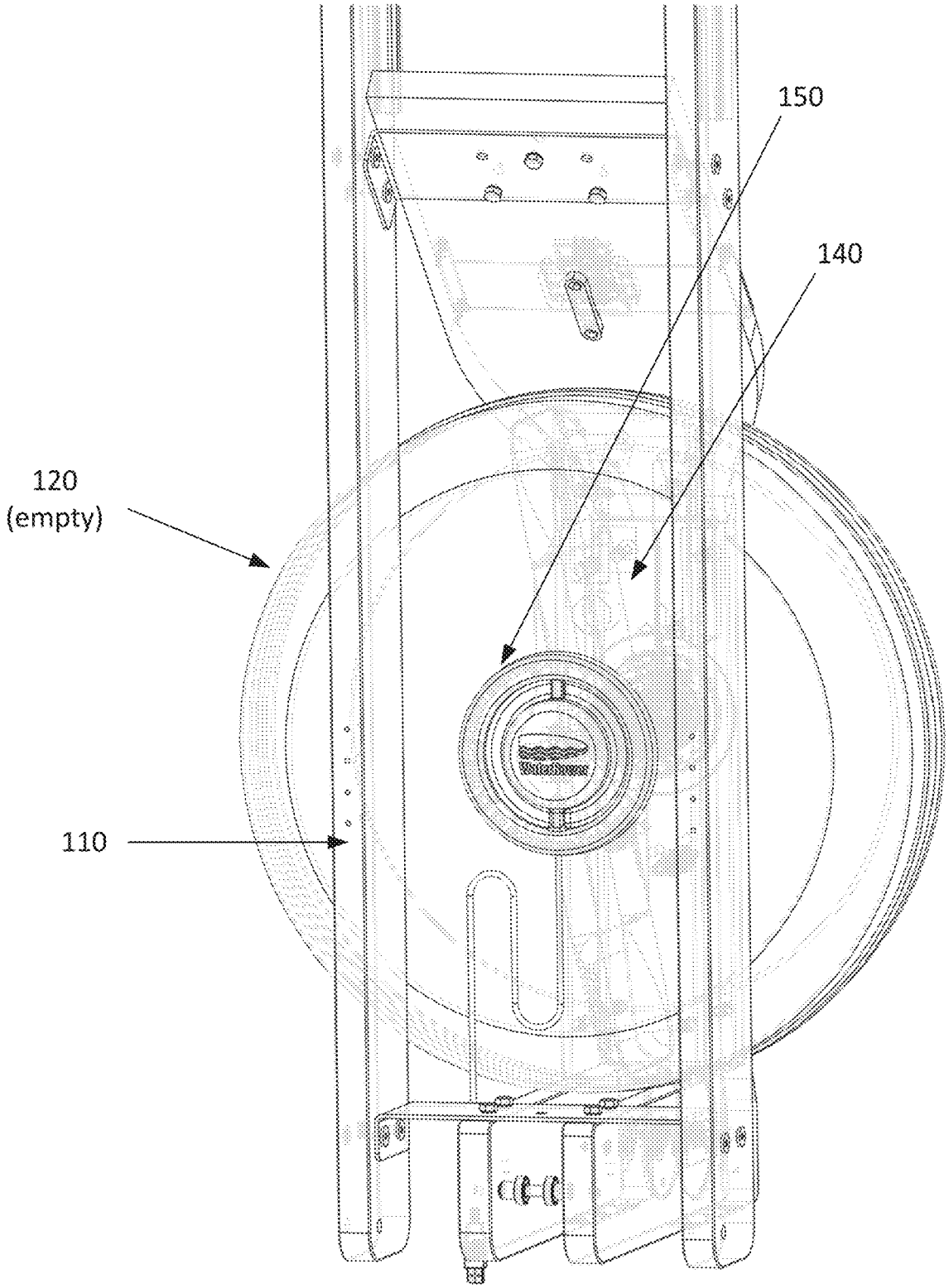
FIGS. 8A-8D are photos of a fluid tank of an exercise machine with an illumination device coupled thereto.
Figure 8B:
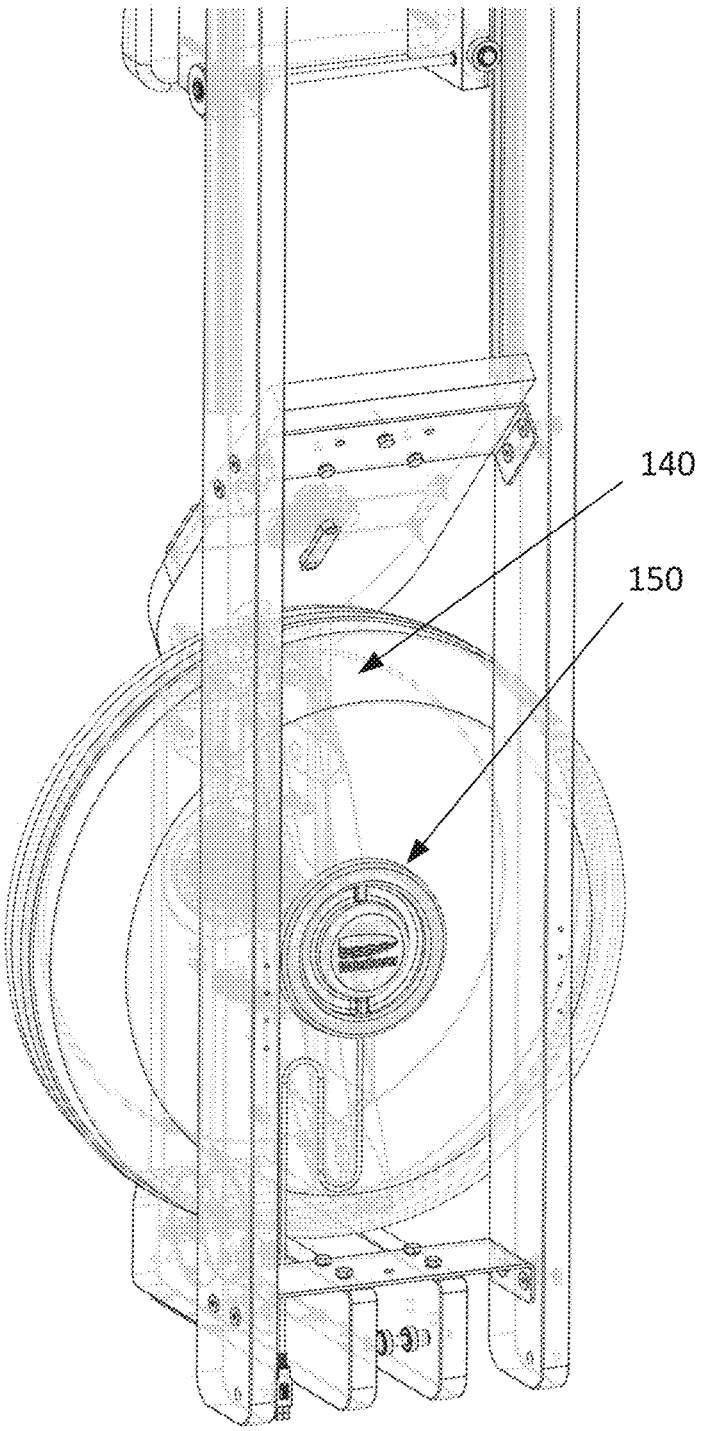

In operation, and as shown in FIGS. 8A and 8B, the illumination housing 160 can be attached to the under-side of the rower machine's 100 fluid tank 120 on the outside using, for example, an adhesive or mechanical coupling. The illumination housing 160 can sit flush against the tank 120 as the LED unit is, with no diffuser. In some instances, the top surface 161 of the illumination housing 160 matches the surface of the fluid tank 120, for example, as shown in FIGS. 8A and 8B, both surfaces are flat. In some instances, there can be a small gap between the light sources 152 and the material of the fluid tank 120 (though it is also considered that clear resin or other material can be used to fill the gap/protect the light sources 152). In some instances, the illumination housing 160 sits in the center of the fluid tank 120, such that a hole in center of the illumination housing 160 can be used to line it up to the axel 121 of the water paddles 140. In some instances, the fluid tank 120 itself is clear and allows all the light though.

Figure 8C:
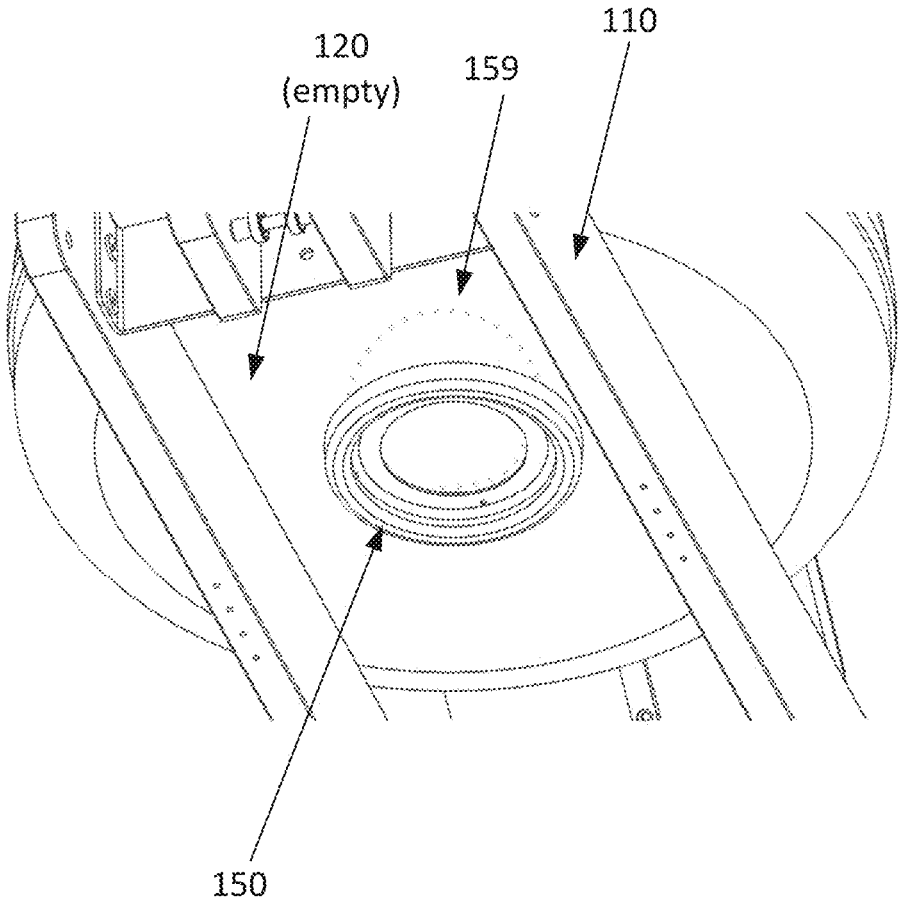
Figure 8D:
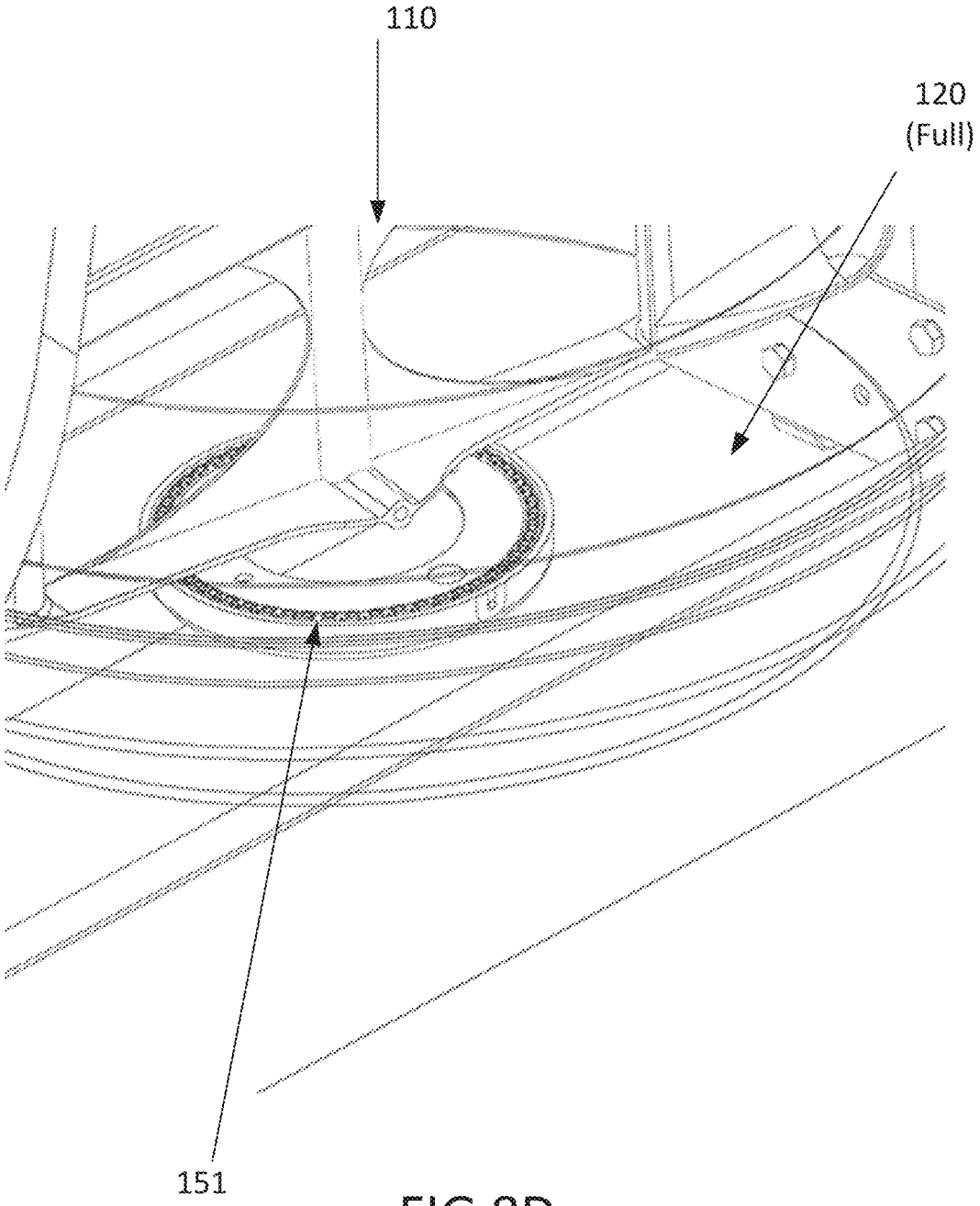

FIGS. 8C and 8D are photographs of an illumination device 150 with a ring-shaped illumination housing 160 and illumination region 151 having a plurality of light sources 152 active. In FIG. 8C an illumination device 150 mounted under an empty fluid tank 120 is shown illuminating the empty fluid tank 120, with a reflection 159 of the light sources 152 of an illumination region 151 visible from the top surface of the fluid tank 120. In FIG. 8D, an illumination housing 160 of an illumination device 150 is mounted under a filled fluid tank 120, with light sources 152 of the illumination device 150 projecting light through the fluid in the fluid tank 120.

One skilled in the art will appreciate further features and advantages of the disclosure based on the above-described embodiments. Accordingly, the disclosure is not to be limited by what has been particularly shown and described, except as indicated by the appended claims. All publications and references cited herein are expressly incorporated herein by reference in their entirety.

What is claimed is:

1. A method of providing visual feedback to a user of an exercise machine including a transparent fluid tank configured to provide a fluid-based resistance force during operation of the exercise machine, the method comprising:

providing a rowing machine having a frame coupled with a seat and a fluid container, the fluid container having a fluid displacement device positioned therein coupled with a drive cord that is configured to be pulled by the user when seated, the rowing machine configured so that the user sitting on the seat faces the fluid container when pulling the drive cord, the fluid displacement device being configured to displace the fluid in the fluid container by rotating the fluid in the fluid container in response to a force exerted by the user, the fluid container being coupled with an illumination housing having face with a recess and a plurality of light sources positioned in the recess, the illumination housing positioned relative to the fluid container to direct light into the fluid tank, the illumination housing being positioned outside of the fluid container and being centrally located with respect to the fluid tank;

directing light into the fluid tank from the plurality of light sources positioned adjacent to the fluid tank to illuminate a fluid inside the fluid tank such that the light is scattered by the fluid and made visible to the user positioned on the seat while pulling the drive cord;

controlling a quality of the light directed into the fluid tank based on a parameter; and adjusting the quality of the light based on the parameter.

2. The method of claim 1, wherein the parameter is adjusted as a function of group feedback.

3. The method of claim 1, wherein the parameter includes at least one of: a heartrate of the user operating the exercise machine, an output rate, a stroke rate, resistance, time, distance, or speed.

4. The method of claim 1, further comprising receiving the parameter during operation of the exercise machine and dynamically controlling the quality of the light based on the parameter.

5. The method of claim 1, wherein the quality of the light being controlled includes a pattern, and the pattern visually corresponds to heartrate pulses.

6. The method of claim 1, wherein the fluid tank has a central axis and the illumination housing includes an alignment feature configured to align the illumination housing with the central axis.

7. The method of claim 6, wherein the central axis is arranged vertically, and the central axis defines an axis of rotation of a resistance device positioned inside the fluid tank.

8. An exercise machine assembly comprising:

a frame coupled with a seat and a transparent fluid tank, the transparent fluid tank having a fluid displacement device positioned therein coupled with a drive cord that is configured to be pulled by the user when the user is positioned on the seat, the rowing machine configured so that the user sitting on the seat faces the fluid tank when pulling the drive cord, the fluid tank configured to provide a fluid-based resistance force and allow a user to exert a force against the fluid-based resistance force during operation of the exercise machine assembly; and an illumination device with an illumination housing having a top face with a recess and a plurality of light sources positioned in the recess, the illumination device positioned adjacent to the fluid tank and position to direct light from the plurality of light sources of the illumination device into the transparent fluid tank, wherein the illumination device is configured to adjust a quality of the light based on a parameter received by the illumination device, the parameter related to a characteristic of the user.

9. The exercise machine assembly of claim 8, wherein the parameter comprises an exercise-related parameter received by the illumination device during operation of the exercise machine.

10. The exercise machine assembly of claim 9, wherein the exercise-related parameter includes at least one of: a heartrate of the user, an output rate, a stroke rate, resistance, time, distance, or speed.

11. The exercise machine assembly of claim 10, wherein the parameter is a heartrate, the exercise machine assembly further comprising an input configured to receive the heartrate of the user operating the exercise machine assembly.

12. The exercise machine assembly of claim 8, further comprising an alignment feature configured to align the illumination housing with a central axis of the fluid tank.

13. A fluid-resistance tank illumination device comprising:

a housing having a first side configured to be positioned against an exterior surface of a transparent fluid tank of a fluid-resistance exercise machine, the first side defining a light emitting region;

one or more light sources disposed in a recess formed in a central region of the housing and arranged to direct light via the light emitting region into a region of the fluid tank where the light is configured to be scattered by a fluid contained in the transparent fluid tank during operation of the fluid-resistance tank; and a control unit configured to adjust a quality of the light directed into the fluid tank based on a parameter received from a group of users by the control unit.

14. The illumination device of claim 13, wherein the parameter is an exercise-related parameter.

15. The illumination device of claim 14, wherein the exercise-related parameter includes at least one of: a heartrate, an output rate, a stroke rate, resistance, time, distance, or speed related to a user operating the fluid-resistance exercise machine.

16. The illumination device of claim 13, wherein the control unit comprises a communication module configured to receive the parameter from the group of users.

17. The illumination device of claim 13, wherein the first side is configured to be directly affixed to the exterior surface, and further comprising an alignment feature configured to align the housing with a central axis of the fluid tank.

18. The illumination device of claim 13, wherein the light emitting region defines a ring sized to surround a central axis of a rotary device positioned inside the fluid tank.

19. The illumination device of claim 13, wherein the parameter is a rate based parameter.

* * * * *